US007306510B2

(12) United States Patent
Nakamura et al.

(10) Patent No.: US 7,306,510 B2
(45) Date of Patent: Dec. 11, 2007

(54) METHOD OF ADHERING POLISHING PADS AND JIG FOR ADHERING THE SAME

(75) Inventors: Yoshio Nakamura, Nagano (JP); Harumichi Koyama, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 11/580,889

(22) Filed: Oct. 16, 2006

(65) Prior Publication Data

US 2007/0087671 A1 Apr. 19, 2007

(30) Foreign Application Priority Data

Oct. 17, 2005 (JP) ..... 2005-301330

(51) Int. Cl.
*B24B 1/00* (2006.01)

(52) U.S. Cl. ..... 451/56; 451/458

(58) Field of Classification Search ..... 451/56, 451/72, 443, 444, 458, 291
See application file for complete search history.

(56) References Cited

U.S. PATENT DOCUMENTS 7,125,326 B2 * 10/2006 Walsh et al. ..... 451/442
2007/0054606 A1 * 3/2007 Nakamura et al. ..... 451/56

FOREIGN PATENT DOCUMENTS

JP 2000-42912 A 2/2000

* cited by examiner

*Primary Examiner*—Robert A. Rose
(74) *Attorney, Agent, or Firm*—Birch, Stewart, Kolasch & Birch, LLP

(57) ABSTRACT

The method of adhering polishing pads is capable of easily exchanging polishing pads in a comfortable posture. The method comprises the steps of: setting a pad adhering carrier, which has a through-hole in which a roller unit for pressing polishing pads is fixed, in a holder with arranging a roller unit in a radial direction of a lower polishing plate and an upper polishing plate; relatively moving the upper polishing plate toward the lower polishing plate so as to clamp the roller unit between the lower polishing plate and the upper polishing plate with a prescribed force; rotating the lower polishing plate and the upper polishing plate, which clamp the roller unit, in the opposite directions at the same speed; and pressing the polishing pads onto polishing faces of the lower polishing plate and the upper polishing plate by the roller unit.

14 Claims, 5 Drawing Sheets

METHOD OF ADHERING POLISHING PADS AND JIG FOR ADHERING THE SAME

BACKGROUND OF THE INVENTION

The present invention relates to a method of adhering polishing pads of a polishing apparatus, which is capable of simultaneously polishing both faces of a work piece, and a suitable jig for the method.

Various types of polishing apparatuses, each of which is capable of simultaneously polishing both faces of a work piece, e.g., wafer, are known. For example, Japanese Patent Gazette No. 2000-42912 discloses a conventional polishing apparatus, in which a carrier holding wafers is circularly moved without rotating about its own axis between a lower polishing plate and an upper polishing plate, which can be independently rotated, so as to simultaneously polish the both faces of the wafers.

The conventional polishing apparatus disclosed in the Japanese patent gazette will be explained. FIG. 7 is an exploded perspective view of the polishing apparatus; FIG. 8 is a sectional view of the polishing apparatus shown in FIG. 7.

The polishing apparatus 100 comprises: a carrier 12 formed into a thin circular disk having through-holes 12*a*; an upper polishing plate 14 having a polishing face 14*a*; a lower polishing plate 16 having a polishing face 16*a* and being relatively moved toward and away from the upper polishing plate 14; a carrier orbiting unit circularly moving the carrier 12, without rotating about its own axis, together with wafers 10 between the lower and the upper polishing plates 14 and 16; a slurry feeding unit 85 pressurizing and feeding slurry to the polishing faces 14*a* and 16*a* contacting the wafers 10 via slurry feeding holes (not shown) of the upper polishing plate 14 and/or the lower polishing plate 16.

In polishing apparatuses, polishing pads, which are adhered on polishing faces of polishing plates, are gradually abraded with polishing wafers. Therefore, polishing pads must be exchanged periodically. In the above described conventional polishing apparatus capable of simultaneously polishing both faces of the wafers, the polishing pads adhered on the upper polishing plate and the lower polishing plate must be exchanged. However, the polishing pad adhered on the upper polishing plate must be exchanged in an uneasy posture, so that it takes a long time to exchange the polishing pads.

In the polishing apparatus, the polishing faces, which will contact the wafers, must be highly precisely flat, so the polishing pads must be securely closely adhered on the lower polishing plate and the upper polishing plate. The polishing pad can be easily adhered on the lower polishing plate. However, as described above, the polishing pad adhered on the upper polishing plate is exchanged in the uneasy posture, so it is difficult to closely adhere the polishing pad on the polishing face of the upper polishing plate. If the uneven polishing pads contact the wafers, the wafers cannot be polished uniformly. Production yield must be lowered.

SUMMARY OF THE INVENTION

The present invention was conceived to solve the above described problems.

An object of the present invention is to provide a method of adhering polishing pads of a polishing apparatus, which is capable of easily exchanging polishing pads in a comfortable posture.

Another object is to provide a suitable jig for said method.

To achieve the objects, the present invention has following structures.

Namely, the method of adhering polishing pads is performed in a polishing apparatus including: a lower polishing plate having a polishing face, on which the polishing pad is adhered; an upper polishing plate being provided above the lower polishing plate, the upper polishing plate having a polishing face, on which the polishing pad is adhered; a holding unit holding and moving the upper polishing plate in the vertical direction; a carrier having a through-hole, in which a wafer can be held, the carrier being provided between the lower polishing plate and the upper polishing plate with a holder; a rotary driving unit rotating the lower polishing plate and the upper polishing plate about their axial lines; and an orbit driving unit being connected to the holder, the orbit driving unit orbiting the carrier and the holder without rotating about their axial lines, so an upper face and a lower face of the wafer, which is sandwiched between the lower polishing plate and the upper polishing plate, are simultaneously polished by rotating the lower polishing plate and the upper polishing plate and orbiting the carrier. The method for simultaneously adhering the polishing pads to the lower polishing plate and the upper polishing plate comprises the steps of:

detaching the carrier form the holder;

tentatively adhering the polishing pads to the polishing faces of the lower polishing plate and the upper polishing plate;

setting a pad adhering carrier, whose size is almost equal to that of the carrier and which has a through-hole in which a roller unit for pressing the polishing pads is fixed, in the holder with arranging the roller unit in a radial direction of the lower polishing plate and the upper polishing plate;

moving the upper polishing plate toward the lower polishing plate so as to clamp the roller unit between the lower polishing plate and the upper polishing plate with a prescribed force;

rotating the lower polishing plate and the upper polishing plate, which clamp the roller unit, in the opposite directions at the same speed; and pressing the polishing pads onto the polishing faces of the lower polishing plate and the upper polishing plate by the roller unit.

Preferably, the pad adhering carrier can be vertically moved with respect to the holder.

In the method, a plurality of the roller units may be fixed to the pad adhering carrier.

Preferably, one of the roller units is extended beyond the centers of the lower polishing plate and the upper polishing plate.

Preferably, each of the roller units has a roller member, and the roller member is constituted by a plurality of split roller members arranged in an axial direction of a shaft.

In this case, preferably, the roller units are set in the pad adhering carrier, and tracks of the ends of the split roller members of one of the roller units do not overlap those of another roller unit.

In the method, the roller unit may have a roller member, and a projected section having a prescribed width may be spirally formed in an outer circumferential face of the roller member.

The jig is used for adhering polishing pads of a polishing apparatus including: a lower polishing plate having a polishing face, on which the polishing pad is adhered; an upper polishing plate being provided above the lower polishing plate, the upper polishing plate having a polishing face, on which the polishing pad is adhered; a holding unit holding and moving the upper polishing plate in the vertical direction; a carrier having a through-hole, in which a wafer can be held, the carrier being provided between the lower polishing plate and the upper polishing plate with a holder; a rotary driving unit rotating the lower polishing plate and the upper polishing plate about their axial lines; and an orbit driving unit being connected to the holder, the orbit driving unit orbiting the carrier and the holder without rotating about their axial lines, wherein an upper face and a lower face of the wafer, which is sandwiched between the lower polishing plate and the upper polishing plate, are simultaneously polished by rotating the lower polishing plate and the upper polishing plate and orbiting the carrier. The jig for simultaneously adhering the polishing pads to the lower polishing plate and the upper polishing plate comprises:

a pad adhering carrier being capable of being attached to the holder instead of the carrier, the pad adhering carrier having a through-hole; and a roller unit being fixed in the through-hole of the pad adhering carrier, the roller unit pressing the polishing pads, which have been tentatively adhered on the polishing faces of the lower polishing plate and the upper polishing plate when the pad adhering carrier is attached to the holer.

In the jig, the pad adhering carrier may be vertically moved with respect to the holder.

In the jig, a plurality of the roller units may be fixed to the pad adhering carrier.

In the jig, one of the roller units may be extended beyond the centers of the lower polishing plate and the upper polishing plate.

In the jig, each of the roller units may have a roller member, and the roller member may be constituted by a plurality of split roller members arranged in an axial direction of a shaft.

In the jig, the roller units may be set in the pad adhering carrier, and tracks of the ends of the split roller members of one of the roller units do not overlap those of another roller unit.

In the jig, the roller unit may have a roller member, and a projected section having a prescribed width may be spirally formed in an outer circumferential face of the roller member.

By employing the method and the jig of the present invention, the polishing pads can be easily adhered onto the polishing face of the upper polishing plate, and a required time for adhering the polishing pads can be much shortened. Further, the polishing pads can be highly precisely adhered onto the polishing plates, so that the wafer can be uniformly polished and production yield can be improved.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1A:
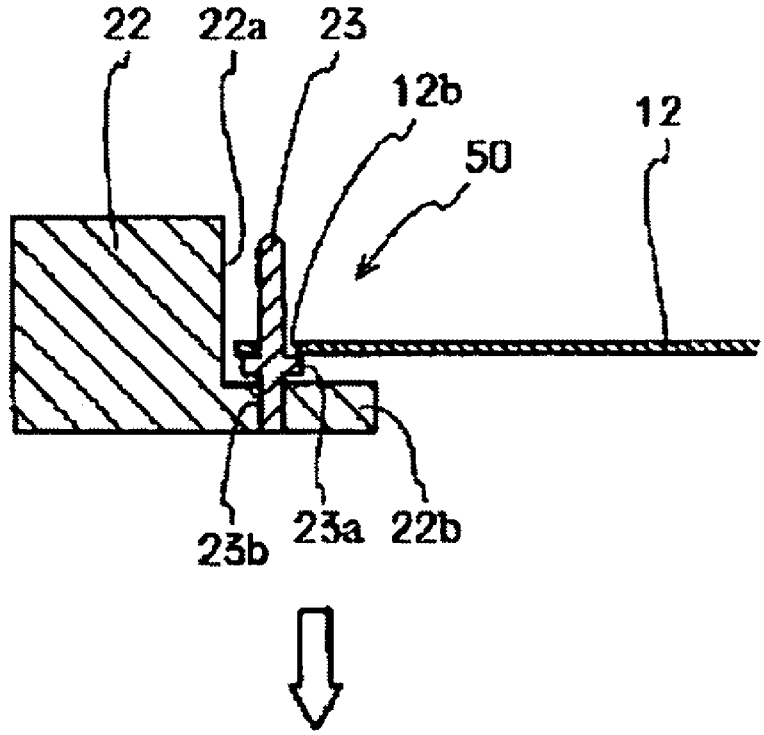
FIGS. 1A and 1B are partial sectional views of a main part of link means.
Figure 1B:
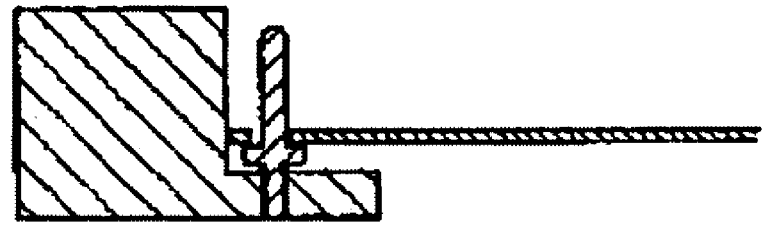
Figure 7:
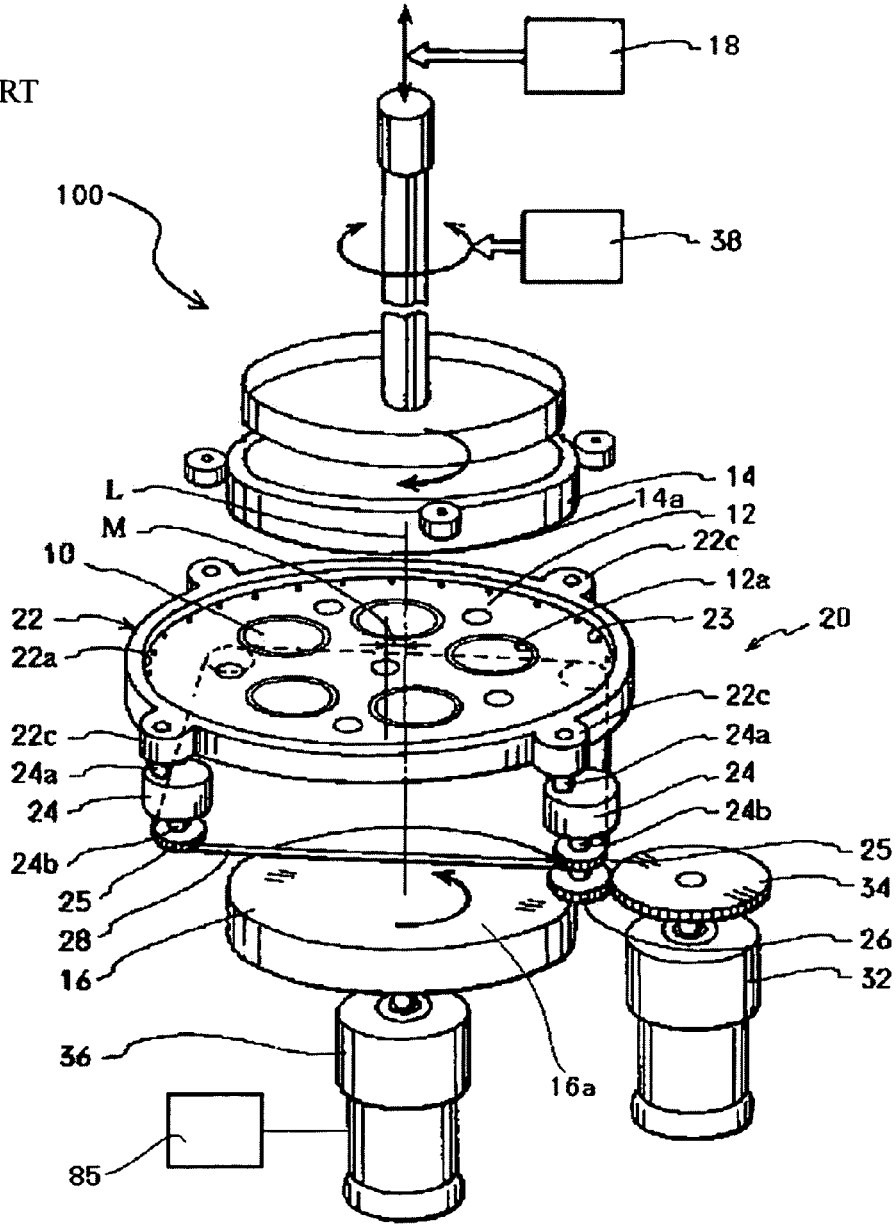
FIG.7 PRIOR ART
FIG. 7 is an exploded perspective view of the conventional polishing apparatus.

A polishing apparatus 100 of the present embodiment is capable of polishing silicon wafers 10. A basic structure of the polishing apparatus 100 is the same as that of the conventional apparatus described in BACKGROUND OF THE INVENTION. The basic structure of the polishing apparatus 100 will be further explained with reference to FIGS. 1, 7 and 8. Note that, FIGS. 1A and 1B are partial sectional views of a main part of link means. In the following description, work pieces to be polished are silicon wafers, but other work pieces, e.g., glass plates, can be polished as work pieces.

A holding unit 18 holds the upper polishing plate 14 and is capable of moving the upper polishing plate 14 toward and away from the lower polishing plate 16. Polishing pads 14*a* and 16*a* are respectively adhered on surfaces of the polishing plates 14 and 16. The polishing pads 14*a* and 16*a* constitute the polishing faces. The circular wafers 10 are loosely fitted in the through-holes 12*a* of the circular carrier 12 and capable of rotating therein.

The holding unit 18 is, for example, a cylinder unit driven by fluid pressure. As described above, the holding unit 18 holds and moves the upper polishing plate 14 toward and away from the lower polishing plate 16. Further, the holding unit 18 adjusts a pressing force for pressing the upper polishing plate 14 onto the lower polishing plate 16 when the both faces of the wafers 10 are polished and when the polishing pads 14*a* and 16*a* are adhered onto the polishing plates 14 and 16.

An orbit driving unit 20 moves the carrier 12 along a circular orbit, without rotating about its axial line, in a plane parallel to the polishing plates 14 and 16. Therefore, the wafers 10, which have been accommodated in the through-holes 12*a*, are moved round between the polishing plates 14 and 16. The orbit driving unit 20 will be explained.

Figure 8:
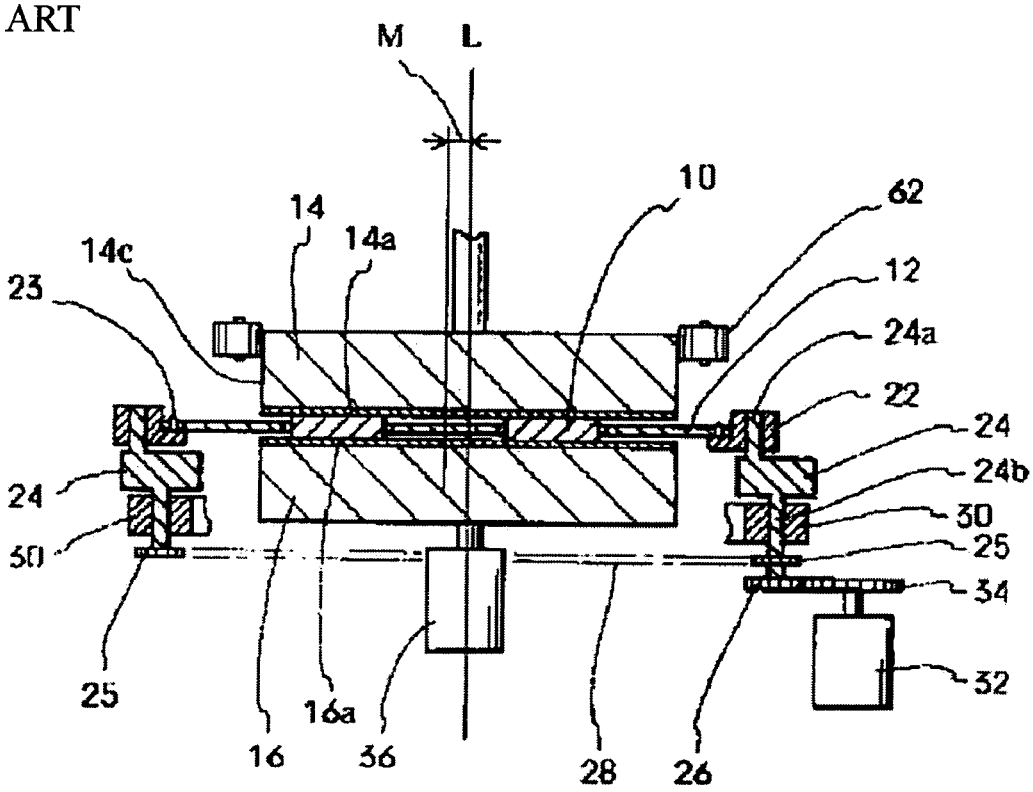
FIG.8 PRIOR ART
FIG. 8 is a sectional view of the conventional polishing apparatus shown in FIG. 7.

Each of eccentric arms 24 has a shaft 24*a*, which is arranged parallel to a common axial line L of the polishing plates 14 and 16 and rotatably connected to a carrier holder 22, and a shaft 24*b*, which is arranged parallel to the shaft 24*a*, separated a prescribed distance from the shaft 24*a* and rotatably connected to a base 30 (see FIG. 8). Namely, the eccentric arms 24 including the shafts 24*a* and 24*b* constitute a crank mechanism. In the present embodiment, four eccentric arms 24 are provided between the base 30 and the carrier holder 22 so as to support the carrier holder 22 and move the shafts 24*a* on the holder 22 side around the shafts 24*b* on the base 30 side. With this structure, the carrier holder 22 can be moved around the base 30 without rotating about its own axis.

Each of the shafts 24*a* is inserted and rotatably held in a bearing, which is projected from an outer circumferential face of the carrier holder 22. A center of the carrier 12 is separated a distance M from the axial line L of the polishing plate 14 and 16 and moved around the axial line L along the circular orbit, whose radius is M. Therefore, the carrier 12 is moved round (orbited) without rotating about its own axis. All points in the carrier 12 are simultaneously equally moved round.

A timing chain 28 is engaged with four sprockets 25, each of which is coaxially fixed to the shaft 24*b* of each eccentric arm 24. The timing chain 28 and the sprockets 25 constitute a synchronizing means, which links and synchronizes the shafts 24*b* on the base 30 side, so as to synchronously orbit the eccentric arms 24. The synchronizing means has the simple structure and is capable of stably moving the carrier 12. Note that, the synchronizing means is not limited to the present embodiment, other means, e.g., gear mechanism, may be employed. A motor 32, e.g., geared motor, has an output shaft, and an output gear 34 is fixed to the output shaft. The gear 34 is engaged with a gear 26, which is coaxially fixed to the shaft 24*b* of one of the eccentric arms 24. With this structure, the orbit driving unit 20, which moves the eccentric arms 24 around the shafts 24*b*, can be constituted.

The orbit driving unit may be constituted by a plurality of motors, e.g., electric motors, which respectively move the eccentric arms 24. By electrically synchronizing the electric motors, the eccentric arms 24 can be easily synchronized and the carrier 12 can be smoothly moved. In the above described embodiment, four eccentric arms 24 are provided, but number of the eccentric arms 24 may be three or more so as to suitably support the carrier holder 22.

A rotary driving unit 36, e.g., geared motor, rotates the lower polishing plate 16. An output shaft of the motor 36 may be directly connected to a rotary shaft of the lower polishing plate 16. A rotary driving unit 38, e.g., motor, rotates the upper polishing plate 14. The rotary driving units 36 and 38 are manually or automatically controlled so as to optionally control rotational directions and rotational speeds of the polishing plates 14 and 16, so that the wafers can be optionally polished. In the polishing apparatus 100, the wafers 10, which have been accommodated in the through-holes 12*a* of the carrier 12, are sandwiched between the polishing plates 14 and 16 so as to polish both faces of the wafers 10. A force for clamping the wafers 10 is mainly applied by the holding unit 18. Fluid pressure in the cylinder unit, which constitutes the holding unit 18, is manually or automatically controlled so as to clamp the wafers 18 with the suitable clamping force.

Link means 50, which links the carrier 12 with the carrier holder 22, will be explained.

FIGS. 1A and 1B are partial sectional views of a main part of the link means 50. The link means 50 links the carrier 12 with the carrier 22 so as to prevent rotation of the carrier 12 and absorb thermal expansion thereof. As shown in FIGS. 1A and 1B, the link means 50 is constituted by: pins 23 provided to the carrier holder 22; and long holes 12*b*, each of which is extended in a direction of thermal expansion, e.g., a radial direction of the carrier 12, so as to loosely fit the pin 23 therein. Note that, the long holes 12*b* are extended at least in the directions of thermal expansion.

In the present embodiment, a clearance is formed between an outer edge of the carrier 12 and an inner circumferential face 22*a* of the carrier holder 22, so that thermal expansion of the carrier 12 can be suitably allowed. Namely, an outer diameter of the carrier 12 is slightly shorter than an inner diameter of the inner circumferential face 22*a*. As described above, the holes 12*b* of the carrier 12 are formed into long holes so as to absorb thermal expansion, and the carrier 12 is set in the carrier holder 22 by respectively fitting the pins 23 in the holes 12*b*. By employing the link means 50 capable of absorbing thermal expansion of the carrier 12, the carrier 12 can be linked with the carrier holder 22, without rotation, by the simple structure. With this structure, the thermal expansion of the carrier 12 can be absorbed, and deformation of the carrier 12 can be prevented. The carrier 12 can be attached by merely fitting in the carrier holder 22, so the carrier 12 can be easily set.

Next, a mechanism for adjusting a height of the carrier 12 will be explained with reference to FIGS. 1A and 1B. Each of the pins 23 has a flange section 23*a*, which is formed like a washer and integrated at a mid part. The flange sections 23*a* directly support the carrier 12. Each of the pins 23 further has a screw section, which is formed under the flange section 23*a* and screwed with a lower section 22*b* of the carrier holder 22. Heights of the flange sections 23*a* can be adjusted by turning the screw sections of the pins 23. By adjusting the heights of the flange sections 23*a*, the height of the carrier 12 with respect to the carrier holder 22 can be suitably adjusted.

For example, even if the polishing pad 16*a* of the lower polishing plate 16 is abraded, the carrier 12 can be supported as high as the polishing pad 16*a*, without flexure, by adjusting the heights of the flange sections 23*a*. Therefore, the carrier 12 can be horizontally supported, so that breaking the wafers 10 and reducing polishing accuracy can be prevented. Since the outer edge of the carrier 12 is partially supported by upper faces of the flange sections 23*a*, slide of the carrier 12, which is occurred by thermally expanding and shrinking the carrier 12, can be suitably allowed. Namely, contact area between a lower face of the carrier 12 and an upper face of the carrier holder 22 can be small, so that sliding friction therebetween can be reduced. Therefore, the carrier 12 can suitably slide. An expanding force and a shrinking force of the carrier 12, which are generated by heat, are suitably released, so that deformation of the carrier 12 can be prevented.

Figure 2:
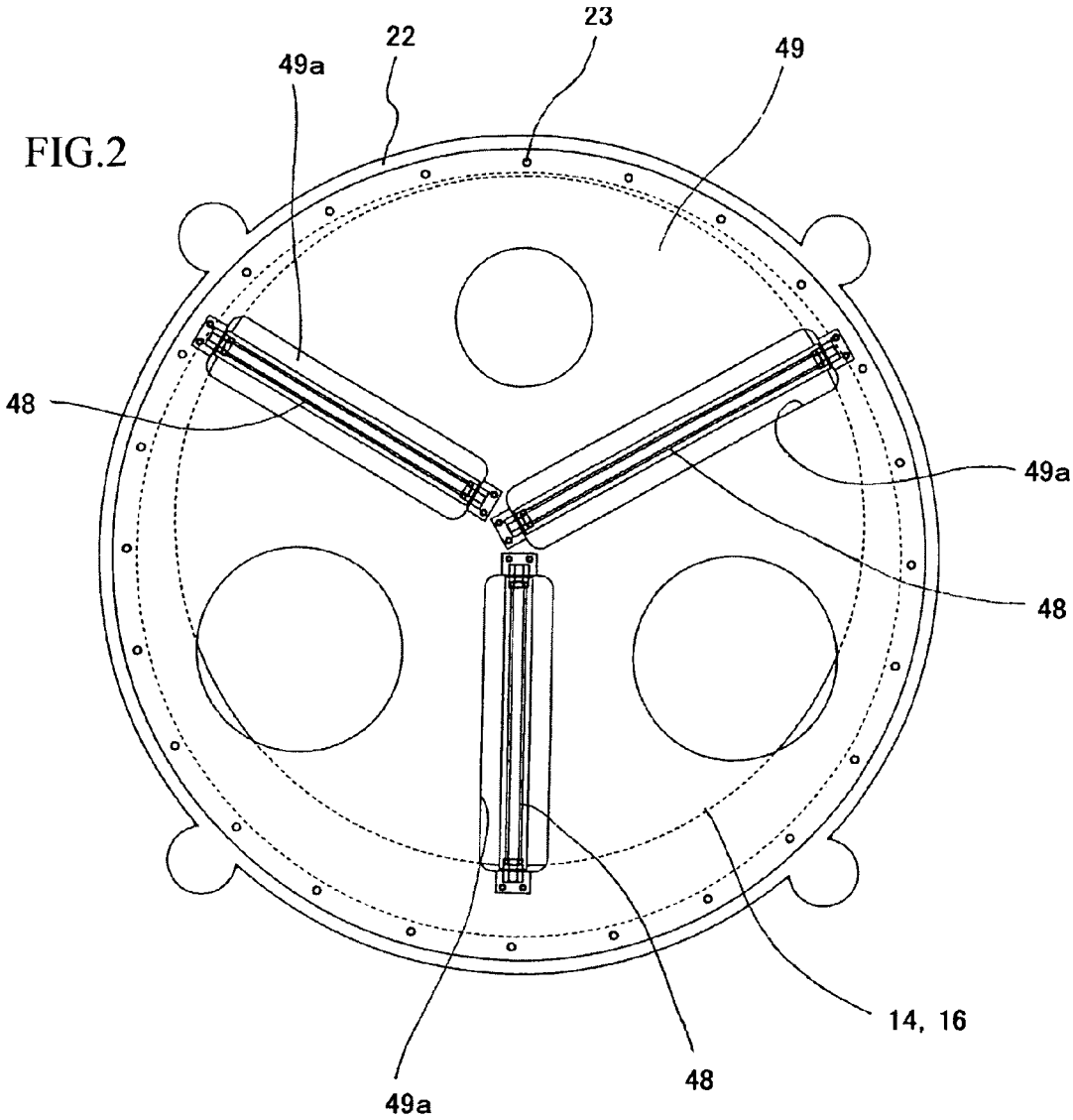
FIG. 2 is a plan view of a carrier holder, in which a specific carrier is set.
Figure 3:
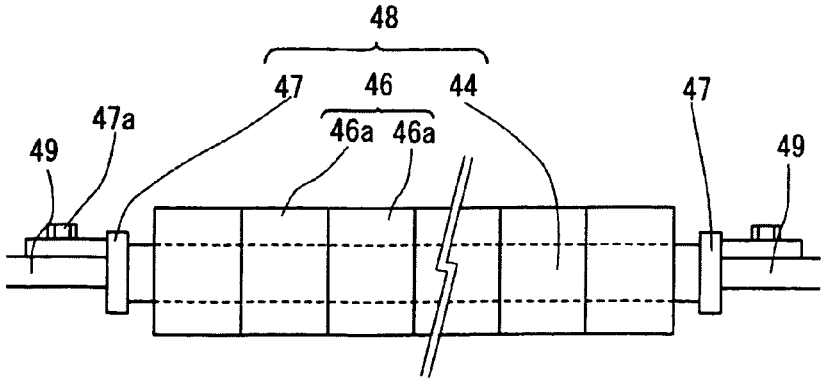
FIG. 3 is a side view of a roller unit.

The basic structure of the polishing apparatus 100 of the present embodiment has been explained. Next, a method of adhering the polishing pads 14*a* and 16*a* of the polishing apparatus 100 and a jig for adhering the polishing pads 14*a* and 16*a* will be explained. The present embodiment is characterized by setting a specific carrier 49, which works as a pad adhering carrier, in the carrier holder 22 instead of the carrier 12. FIG. 2 is a plan view of the carrier holder 22, in which the specific carrier 49 is set. FIG. 3 is an explanation view of a roller unit 48.

The specific carrier 49 is made of synthetic resin, e.g., vinyl chloride, and formed into a circular disk. Long holes, which are extended in the radial direction, or circular holes, whose diameters are greater than an outer diameter of the pin 23, are formed in an outer edge part of the specific carrier 49, and the pins 23 can be loosely fitted in the holes. Therefore, the specific carrier 49 can be attached to the carrier holder 22 instead of the carrier 12. Even if the specific carrier 49 is thermally expanded, the expansion can be absorbed by the holes. The specific carrier 49 can be moved upward and downward with respect to the carrier holder 22.

Long through-holes 49*a*, which are extended in the radial directions, are formed in the specific carrier 49 with angular separations of 120 degrees. The roller units 48 are respectively provided in the through-holes 49*a*.

As shown in FIG. 2, a center of the specific carrier 49 is shifted from the centers of the polishing plates 14 and 16. The roller units 48, which are provided in the through-holes

49*a*, are arranged in the radial directions with respect to the polishing plates 14 and 16. In some cases, the roller units 48 cannot be arranged in the radial directions of the polishing plates 14 and 16 due to a position of the specific carrier 49 in the carrier holder 22. Thus, the roller units 48 are correctly arranged in the radial directions of the polishing plates 14 and 16 when the specific carrier 49 is attached to the carrier holder 22, or the specific carrier 49 is orbited, by the orbit driving unit 20, so as to arrange the roller units 48 in the radial directions of the polishing plates 14 and 16.

Note that, by arranging the roller units 48 in the radial directions, axial lines of shafts 44 of the roller units 48 are extended in the radial directions. The word "radial direction" means not only the true radial direction but also directions slightly shifted from the true radial direction.

The carrier 12, which will be used for polishing the wafers 10, must be a thin disk. On the other hand, the specific carrier 49 need not be a thin disk, but the specific carrier 49 is made of a tough material so as to securely hold the roller units 48. By using the specific carrier 49 made of the tough material, breaking the specific carrier 49 can be prevented even if the roller units 48 are clamped with large forces when the polishing pads 14*a* and 16*a* are adhered.

Next, the roller units 48 will be explained.

Figure 4:
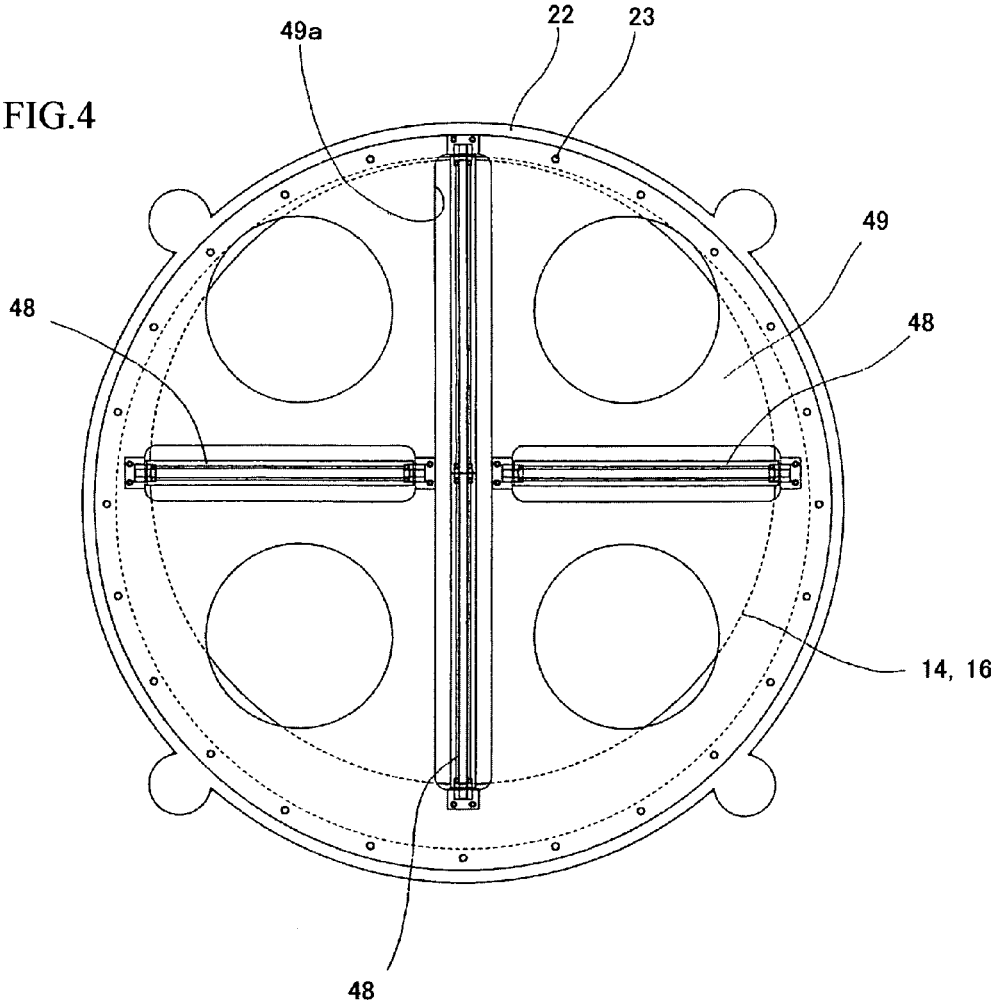
FIG. 4 is a plan view the carrier holder, in which the special carrier, which includes the roller unit having a length nearly equal to diameters of a lower polishing plate and an upper polishing plate, is set.

Lengths of the roller units 48 are designed to securely press the outer edges of the polishing plates 14 and 16 by outer end parts of the roller units 48 when the roller units 48 are arranged in the radial directions of the polishing plates 14 and 16. The outer end parts of the roller units 48 may be projected from the outer edges of the polishing plates 14 and 16. An inner end of one of the roller units 48 reaches the centers of the polishing plates 14 and 16 or extends beyond the centers. With this structure, the entire polishing faces of the polishing plates 14 and 16 can be pressed by the roller units 48. In FIG. 4, a length of one of the roller units (long roller unit) 48 is nearly equal to the diameters of the polishing plates 14 and 16. Two of the short roller units 48 are arranged perpendicular to the long roller unit 48.

As shown in FIG. 3, each of the roller unit 48 includes the shaft 44 and a roller member 46, which is rotatably attached to the shaft 44. Both ends of the shaft 44 are respectively supported by L-shaped members 47, which are fixed to the specific carrier 49 by bolts 47*a*. With this structure, the roller unit 48 can be held in the through-hole 49*a*. A diameter of the roller member 46 is fully greater than a thickness of the specific carrier 49 and projected from a lower face and an upper face of the specific carrier 49. Therefore, the roller member 46 is capable of pressing the polishing faces of the polishing plates 14 and 16.

As shown in FIG. 3, the roller member 46 is constituted by a plurality of split roller members 46*a*, which are divided in the axial direction of the shaft 44. The split roller members 46*a* can independently rotate on the shaft 44. By employing the split roller members 46*a*, the velocity difference between an inner end and an outer end of the roller member 46, which occurs when the roller members 46 are rotated with contacting the polishing plates 14 and 16, can be absorbed. Since the roller member 46 is constituted by many of the split roller members 46*a*, the velocity difference between an inner end and an outer end of each split roller member 46*a* can be reduced. Therefore, amount of slippage of the roller member 46 constituted by the split roller members 46*a* can be much smaller than that of the single roller member. By reducing the amount of slippage, damaging the polishing pads 14*a* and 16*a* by the roller members 46 can be prevented, so that the polishing pads 14*a* and 16*a* can be highly precisely adhered onto the polishing faces of the polishing plates 14 and 16. The amount of slippage can be reduced by shortening lengths of the split roller members 46*a*.

Figure 5:
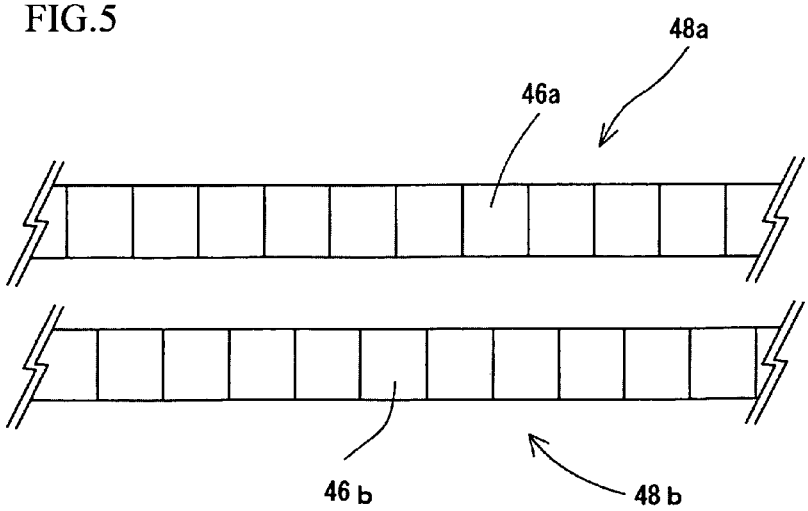
FIG. 5 is an explanation view of split roller members of a plurality of roller units, wherein contact points of the adjacent split roller members are shifted.

On the other hand, by using the roller member 46 constituted by the split roller members 46*a*, joint sections must be formed between the adjacent split roller members 46*a*. The joint sections cannot press the polishing pads. To solve the problem of the joint sections, a plurality of the roller units 48 are used as shown in FIG. 5. In this case, positions of the joint sections of the roller unit 48*a* are shifted from those of another roller unit 48*b*. With this structure, tracks of ends of the split roller members 46*a* of the roller unit 48*a* do not overlap those of another roller unit 48*b*, so that the polishing pads 14*a* and 16*a* can be uniformly pressed. Therefore, the polishing pads 14*a* and 16*a* can be highly precisely adhered onto the polishing faces of the polishing plates 14 and 16.

Successively, the method of adhering the polishing pads 14*a* and 16*a*, which is performed in the polishing apparatus 100, will be explained.

Firstly, a cylinder rod of the holding unit 18 is retracted so as to move the upper polishing plate 14 away from the lower polishing plate 16.

Next, the carrier 12 is detached from the carrier holder 22.

The abraded polishing pads 14*a* and 16*a* are removed from the polishing faces of the polishing plates 14 and 16, the polishing faces are cleaned, then the new polishing pads 14*a* and 16*a* are tentatively adhered onto the polishing faces of the polishing plates 14 and 16. Adhering means, e.g., double-stick tape, has been provided on adhering faces of the polishing pads 14*a* and 16*a* so as to tentatively adhere.

When the polishing pads 14*a* and 16*a* are adhered onto the new polishing plates 14 and 16, the step of removing the abraded pads and the step of cleaning the polishing faces can be omitted.

After the new polishing pads 14*a* and 16*a* are tentatively adhered on the polishing plates 14 and 16, the specific carrier 49 for adhering the pads is set in the carrier holder 49. In this step, the roller units 48, which have been provided in the specific carrier 49, are arranged in the radial directions of the polishing plates 14 and 16. If the roller units 48 are shifted from the radial directions of the polishing plates 14 and 16 when the specific carrier 49 is set in the carrier holder 22, the carrier holder 22 is orbited by the orbit driving unit 20 so as to move the carrier holder 22 until the roller units 48 are arranged in the radial directions of the polishing plates 14 and 16. When the roller units 48 are arranged in the radial directions, the orbital movement of the carrier holder 22 is stopped.

After the specific carrier 49 is set instead of the carrier 12, the cylinder rod of the holder unit 18 is extended so as to move the upper polishing plate 14 toward the lower polishing plate 16. After the upper polishing plate 14 presses the roller members 46 of the roller units 48 onto the lower polishing plate 16 (the roller members 46 are clamped by the polishing plates 14 and 16) with a prescribed force, the polishing plates 14 and 16 are rotated in the opposite directions at the same speed by the rotary driving units 36 and 38. Note that, the orbit driving unit 20 is not actuated.

By rotating the polishing plates 14 and 16, the polishing pads 14*a* and 16*a*, which have been tentatively adhered on the polishing plates 14 and 16, can be uniformly pressed with a prescribed force, so that the polishing pads 14*a* and 16*a* can be automatically and fully adhered onto the polishing plates 14 and 16. Note that, the specific carrier 49 can be moved upward and downward with respect to the carrier holder 49, or the specific carrier 49 is in a floating state.

Therefore, the roller units 48 are capable of uniformly pressing the polishing faces of the polishing plates 14 and 16 without being influenced by the tough specific carrier 49, so that the polishing pads 14*a* and 16*a* can be precisely adhered.

As described above, the roller member 46 of each roller unit 48 is constituted by a plurality of the split roller members 46*a*. The amount of slippage of the roller member 46 constituted by the split roller members 46*a* can be much smaller than that of the single roller member. By reducing the amount of slippage, damaging the polishing pads 14*a* and 16*a* by the roller members 46 can be prevented, so that the polishing pads 14*a* and 16*a* can be highly precisely adhered onto the polishing faces of the polishing plates 14 and 16.

Further, as shown in FIG. 5, the positions of the joint sections of the roller unit 48*a* are shifted from those of the roller unit 48*b*. With this structure, the tracks of the ends of the split roller members 46*a* of the roller unit 48*a* do not overlap the split roller members 46*b* of the roller unit 48*b*, so that the polishing pads 14*a* and 16*a* can be uniformly pressed. Therefore, the polishing pads 14*a* and 16*a* can be highly precisely adhered onto the polishing faces of the polishing plates 14 and 16.

After the polishing pads 14*a* and 16*a* are fully adhered on the polishing plates 14 and 16, the cylinder rod of the holding unit 18 is retracted again so as to move the upper polishing plate 14 away from the lower polishing plate 16. Then, the specific carrier 49 is detached from the carrier holder 22, and the carrier 12 for polishing the wafers 10 is attached to the carrier holder 22. By performing the above described steps, exchanging the polishing pads 14*a* and 16*a* is completed.

Figure 6:
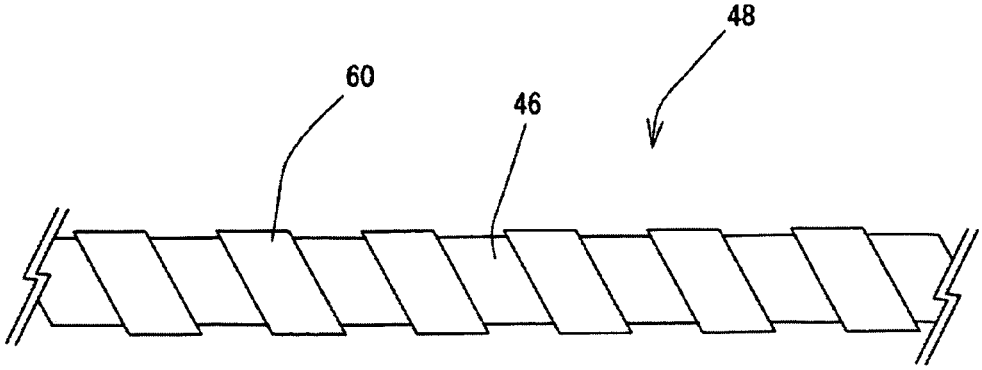
FIG. 6 is an explanation view of a projected section having a prescribed width and being spirally formed in an outer circumferential face of a roller member.

In the above described embodiment, the roller member 46 of the roller unit 48 is constituted by a plurality of the split roller members 46*a*. Further, as shown in FIG. 6, a projected section 60 having a prescribed width may be spirally formed in an outer circumferential face of the roller member 46. By rotating the roller member 46, the spirally projected section 60 outwardly discharges air, which has invaded in spaces formed between the polishing pads 14*a* and 16*a* tentatively adhered and the polishing faces of the polishing pads 14 and 16, from outer edges of the polishing plates 14 and 16. Therefore, the polishing pads 14*a* and 16*a* can be closely adhered on the polishing plates 14 and 16 with high accuracy.

A groove section is formed along the spirally projected section 60, so the velocity difference between the inner end and the outer end of the roller member 46 can be reduced. The circumferential velocities of the outer parts of the polishing plates 14 and 16 are faster than those of the inner parts thereof. Therefore, degrees of abrading the inner part of the roller member 46 is different form that of the outer part thereof. However, by the spiral groove section formed along the projected section 60, the frictional forces can be reduced.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of adhering polishing pads in a polishing apparatus including: a lower polishing plate having a polishing face, on which said polishing pad is adhered; an upper polishing plate being provided above said lower polishing plate, said upper polishing plate having a polishing face, on which said polishing pad is adhered; a holding unit holding and moving said upper polishing plate in the vertical direction; a carrier having a through-hole, in which a wafer can be held, said carrier being provided between said lower polishing plate and said upper polishing plate with a holder; a rotary driving unit rotating said lower polishing plate and said upper polishing plate about their axial lines; and an orbit driving unit being connected to said holder, said orbit driving unit orbiting said carrier and said holder without rotating about their axial lines, wherein an upper face and a lower face of the wafer, which is sandwiched between said lower polishing plate and said upper polishing plate, are simultaneously polished by rotating said lower polishing plate and said upper polishing plate and orbiting said carrier, said method for simultaneously adhering said polishing pads to said lower polishing plate and said upper polishing plate comprising the steps of:

detaching said carrier form said holder;

tentatively adhering said polishing pads to the polishing faces of said lower polishing plate and said upper polishing plate;

setting a pad adhering carrier, whose size is almost equal to that of said carrier and which has a through-hole in which a roller unit for pressing said polishing pads is fixed, in said holder with arranging said roller unit in a radial direction of said lower polishing plate and said upper polishing plate;

moving said upper polishing plate toward said lower polishing plate so as to clamp said roller unit between said lower polishing plate and said upper polishing plate with a prescribed force;

rotating said lower polishing plate and said upper polishing plate, which clamp said roller unit, in the opposite directions at the same speed; and pressing said polishing pads onto the polishing faces of said lower polishing plate and said upper polishing plate by said roller unit.

2. The method according to claim 1, wherein said pad adhering carrier can be vertically moved with respect to said holder.

3. The method according to claim 1, wherein a plurality of said roller units are fixed to said pad adhering carrier.

4. The method according to claim 3, wherein one of said roller units is extended beyond the centers of said lower polishing plate and said upper polishing plate.

5. The method according to claim 3, wherein each of said roller units has a roller member, and the roller member is constituted by a plurality of split roller members arranged in an axial direction of a shaft.

6. The method according to claim 5, wherein said roller units are set in said pad adhering carrier, and tracks of the ends of the split roller members of one of said roller units do not overlap those of another roller unit.

7. The method according to claim 1, wherein said roller unit has a roller member, and a projected section having a prescribed width is spirally formed in an outer circumferential face of the roller member.

8. A jig for adhering polishing pads of a polishing apparatus including: a lower polishing plate having a polishing face, on which said polishing pad is adhered; an upper polishing plate being provided above said lower polishing plate, said upper polishing plate having a polishing face, on which said polishing pad is adhered; a holding unit holding and moving said upper polishing plate in the vertical direction; a carrier having a through-hole, in which a wafer can be held, said carrier being provided between said lower polishing plate and said upper polishing plate with a holder; a rotary driving unit rotating said lower polishing plate and said upper polishing plate about their axial lines; and an orbit driving unit being connected to said holder, said orbit driving unit orbiting said carrier and said holder without rotating about their axial lines, wherein an upper face and a lower face of the wafer, which is sandwiched between said lower polishing plate and said upper polishing plate, are simultaneously polished by rotating said lower polishing plate and said upper polishing plate and orbiting said carrier, said jig for simultaneously adhering said polishing pads to said lower polishing plate and said upper polishing plate comprising:

a pad adhering carrier being capable of being attached to said holder instead of said carrier, said pad adhering carrier having a through-hole; and a roller unit being fixed in the through-hole of said pad adhering carrier, said roller unit pressing said polishing pads, which have been tentatively adhered on the polishing faces of said lower polishing plate and said upper polishing plate when said pad adhering carrier is attached to said holer.

9. The jig according to claim 8, wherein said pad adhering carrier can be vertically moved with respect to said holder.

10. The jig according to claim 8, wherein a plurality of said roller units are fixed to said pad adhering carrier.

11. The jig according to claim 10, wherein one of said roller units is extended beyond the centers of said lower polishing plate and said upper polishing plate.

12. The jig according to claim 10, wherein each of said roller units has a roller member, and the roller member is constituted by a plurality of split roller members arranged in an axial direction of a shaft.

13. The jig according to claim 12, wherein said roller units are set in said pad adhering carrier, and tracks of the ends of the split roller members of one of said roller units do not overlap those of another roller unit.

14. The jig according to claim 8, wherein said roller unit has a roller member, and a projected section having a prescribed width is spirally formed in an outer circumferential face of the roller member.

* * * * *